United States Patent [19]

Donakowski et al.

[11] 4,411,742

[45] Oct. 25, 1983

[54] ELECTROLYTIC CODEPOSITION OF ZINC AND GRAPHITE AND RESULTING PRODUCT

[75] Inventors: William A. Donakowski, Dearborn Heights; John R. Morgan, Southfield, both of Mich.

[73] Assignee: Ford Motor Company, Dearborn, Mich.

[21] Appl. No.: 463,454

[22] PCT Filed: Dec. 1, 1982

[86] PCT No.: PCT/US82/01689

§ 371 Date: Dec. 1, 1982

§ 102(e) Date: Dec. 1, 1982

[51] Int. Cl.[3] ..... C25D 5/48; C25D 7/00; C25D 15/00

[52] U.S. Cl. ..... 204/16; 204/23; 204/38 R

[58] Field of Search ..... 204/16, 23, 35 R, 38 R

[56] References Cited

U.S. PATENT DOCUMENTS

| | | | |
|---|---|---|---|
| 3,061,525 | 10/1962 | Grazen | 204/9 |
| 3,640,799 | 2/1972 | Stephan | 204/16 |
| 3,922,208 | 11/1975 | Cordone | 204/16 |
| 3,932,228 | 1/1976 | Sugiyama | 204/16 |
| 4,036,600 | 7/1977 | Kimura | 204/16 |

OTHER PUBLICATIONS

Plating, Nov. 1969, pp. 1234–1239.
Modern Electroplating, Edited by Towenheim Third Edition 1974, p. 663.
Metal Finishing, Jan. 1960, pp. 58–65.

*Primary Examiner*—T. M. Tufariello
*Attorney, Agent, or Firm*—Joseph W. Malleck; Olin B. Johnson

[57] ABSTRACT

A high lubricity codeposit of zinc and graphite, and an improved method for depositing the codeposit, is disclosed. The coating is characterized by a coefficient of friction equal to or less than 0.130, and a high resistance to corrosion evidenced by no red rust in a salt spray environment for 72 hours and no destruction due to corrosion in an industrial environment, containing sulphur dioxide, for four months. When the codeposit additionally has a chromate outer coating, the system has a coefficient of friction equal to or less than 0.112 and has no red rust in a salt spray environment for at least 120 hours. The codeposit is applied by immersing a cleansed metallic substrate in an acidic zinc plating electrolyte containing at least 40 g/l zinc ions and 30–110 g/l insoluble bulk graphite, with a pH of 5–5.7. The cell of which the electrolyte is a part is energized to plate out a co-deposit; the graphite is continuously agitated while in solution, the agitation being periodically interrupted to allow the graphite to settle and saturate the zinc interface as it is plating out.

20 Claims, 12 Drawing Figures

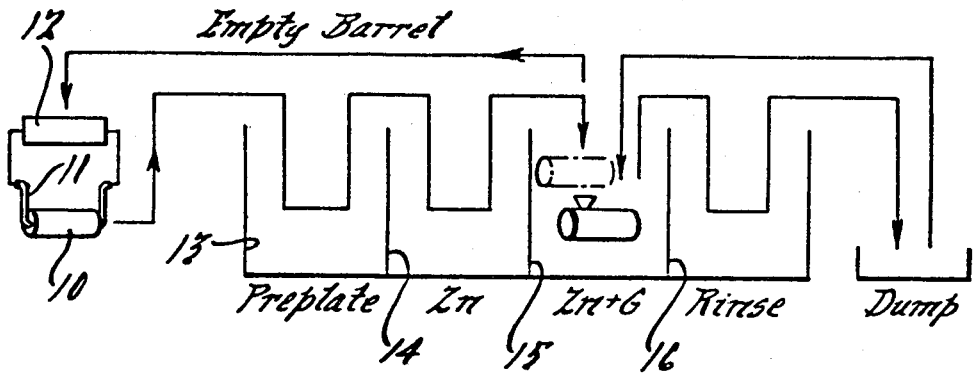
FIG. 1.
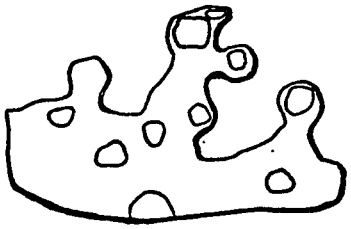
FIG. 2.
FIG. 3.
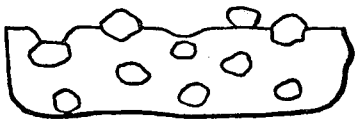

Ni Zn+G Ni Cu

ELECTROLYTIC CODEPOSITION OF ZINC AND GRAPHITE AND RESULTING PRODUCT

BACKGROUND OF THE INVENTION AND PRIOR ART STATEMENT

Automotive metal fasteners are usually coated or plated to enhance various characteristics such as resistance to corrosion, resistance to seizing/galling, low fastening friction, economy, solderability, and resistance to the stick-slip phenomenon (which is a repeated sticking followed by repeated slipping during fastener tightening operations).

To provide resistance to corrosion, it has become conventional in the automotive fastener art to coat the fastener with phosphate and oil or to electroplate with zinc. Unfortunately such coated or plated fasteners are subject to the stick-slip phenomenon when the fastener is tightened with power tools, causing the desired torque loading to sometimes be off target. This stick-slip phenomenon is in part related to a relatively high coefficient of friction for the coating or plating. As the power tool turns the coated or plated nut onto a threaded bolt, the phosphate or zinc is spalled off and collects in small masses to form miniature wedges between the threads. The torque tool will shut off prematurely in response to the effect of these wedges, leaving the mechanical assembly improperly secured under such circumstances, which assembly must later be reworked when identified by an inspecting system.

To obviate the stick-slip problem and to impart a lower coefficient of friction to the coating or plating, cadmium has been employed to impart lubricity and good sacrificial corrosion protection, particularly in a marine environment (see Modern Electroplating, by F. A. Lowenheim, published by John Wiley & Sons, 3rd Edition, p. 663, 1974). However, cadium is subject to two disadvantages: (a) it has a toxic effect during processing, and (b) it is significantly expensive.

A codeposited material which would combine the low coefficient of friction of each of its constituent ingredients would appear to offer potential in meeting the various characteristics desired for an automotive fastener; but this has not necessarily proven to be the case. Experimentation with codeposits of metal and inorganic particles has been reported in the literature.

In an article entitled "Codeposition of Finely Dispersed Inorganic Particles" by Tomaszewski et al, published in Plating, Vol. 56, p. 1234, November 1969, the author investigated using acidic copper plating and acid nickel baths containing various inorganic particles including graphite, $MoS_2$, $BaSO_4$, $SrSO_4$, $Al_2O_3$, $TiO_2$, $ZrO_2$, $H_2Al_2Si_2O_8.H_2O$, $PbSO_4$, $Pb_3(PO_4)_2$, $CeO_2$, BN, $B_6C$, B, Si, and $SiO_2$.

Some of these codeposited particles can be considered nonconductive and normally would not respond to the normal electrolytic action, but it was found that even graphite would plate or codeposit under very strained and undesirable conditions with nickel. The metal matrix and codeposited particles were viewed as to their antifriction, antiseizing, and dry lubrication properties and found them not lower than zinc or cadmium. No investigation was made of the mode of corrosion of such codeposits. Without exploring proper processing parameters, the author concluded that codeposition was feasible only at conventional metal plating parameters. Similar observations were made by Parker as to electroless nickel deposits, entitled "Hardness and Wear Resistance Tests of Electroless Nickel Deposits", Journal of Plating, Vol. 61, p. 834, September 1974. None of the codeposits investigated by these scientists provided a low enough coefficient of friction which would be comparable to cadmium plating now used in the art. Thus these coatings were lacking in a good antigalling characteristic and good corrosion resistance. Nickel does not fail by a sacrifical corrosion mode and thus requires inordinately thick deposits to act as a physical barrier and protect the substrate. The low coefficient of friction of each of the constituent ingredients did not necessarily add up to a total lower coefficient of friction for the codeposited material. In addition, each codeposit lacked good cathode efficiency and low material cost.

One group of investigators, Messrs. Ghouse and Ramachandren, explored the "Antifriction Properties of Electrodeposited Composites of Graphite or Molybdenum Disulfide With Copper", *Journal of Metal Finishing,* Vol. 78, p. 85, June 1981. The amount of second phase material (graphite or $MoS_2$) was found to have a slight effect on total coefficient of friction of the combined material but insufficient to make the codeposit have an improved coefficient of friction comparable to cadmium.

Since nickel by itself is much lower in its coefficient of friction than zinc, and since the codeposit of nickel and graphite fails to provide a significantly lower coefficient of friction for the codeposited material than nickel or graphite, the state of the art must draw or extrapolate from these conclusions that zinc and graphite would be no better in such characteristics than zinc by itself and would have a higher coefficient of friction than nickel.

What is needed by the prior art is a codeposited material and accompanying method of depositing such material, which material is equal to or better than cadmium plating with respect to the coefficient of friction, has no toxic effects, is superior in antiseizing and antigalling characteristics, is high in cathode efficiency, offers reasonably good corrosion resistance in a nonmarine environment, and is solderable.

SUMMARY OF THE INVENTION

The invention is, in a broad aspect, the discovery that a codeposit of zinc and graphite provides an unusually good combination of physical characteristics including a coefficient of friction comparable to cadmium and, in a more particular aspect, an improved method of effectively electrodepositing zinc and graphite onto at least a vertical conductive metal surface.

The codeposit is a high lubricity coating material consisting of electrocodeposited zinc and graphite uniformly distributed, the graphite being present in an amount of 30–48% by weight of the codeposit, and the coating having a coefficient of friction equal to or less than 0.130 at a plated thickness of about 0.005" showing (a) no red rust in a salt spray environment for at least 72 hours, and (b) no destruction due to corrosion in an industrial environment containing sulphur dioxide after four months. It is preferable that the material have a chemically applied layer of zinc chromate at a thickness of 0.00002" so that optimally the coated combination will exhibit consistent torque performance at a torque load of 40 pounds, a coefficient of friction of about 0.112 or less, and no red rust in a salt spray environment for at least 120 hours. When the codeposited coating is applied to a threaded fastener, the fastener will preferably exhibit a consistent torque tension relationship during tightening and have good solderability characteristics using either a resin solder cord or a zinc chloride containing flux.

The method is carried out by the use of an electrolytic cell having a zinc anode and the metal substrate connected as a cathode. The essential steps of the method comprise: (a) immersing the substrate, in a cleansed condition, into an acidic zinc plating electrolyte containing at least 40 g/l zinc ions and 30–110 g/l insoluble bulk graphite, the electrolyte having a pH of 5–5.7; (b) energizing the electrolytic cell at a sufficient current density to plate out zinc onto said surface without burning while continuously agitating said graphite into uniform suspension throughout said solution, said agitation being periodically interrupted to allow said graphite to settle and saturate said zinc interface as it is plating out on said cathode.

Preferably the conductive metal substrate is a metallic threaded fastener which may be comprised of steel, copper, nickel, brass, bronze, zinc and aluminum. The agitation is preferably interrupted for 15–60 seconds at intervals of 15–80 seconds. It is advantageous if the particle size of the graphite employed is of an extremely fine character, and preferably is of a colloidal nature having a particle size of 1–25 microns.

Preferably the electrolyte is of the acid chloride type, created by either mixing 70–85 g/l zinc chloride with 100–150 g/l of potassium chloride, or 45–110 g/l of zinc chloride when dissolved with 100–200 g/l of sodium chloride. The acid chloride bath contains also boric acid in an amount of 26–40 g/l. Optimally the electrolyte may be improved by incorporating a grain refiner in the form of gelatin in an amount of 0.4–1 g/l of electrolyte, and a cationic surfactant in the form of cocamine acetate (having the formula $C_{12}H_{25}NH_3$) in an amount of 0.1–0.4 g/l of electrolyte.

To enhance the corrosion resistance of the codeposited material, the codeposit may be subjected to an additional step of dipping into a chromate passivation solution for a period of about 10–30 seconds in order to form a conversion zinc chromate coating on the outer layer of said codeposit.

Advantageously the cleaning of the substrate may include immersion in a caustic cleansing solution to remove oils and other organic materials followed by a clean water rinse, and then immersion in a pickling solution to remove any oxides thereon, again followed by water rinse. In the plating of a batch of threaded metal fasteners, it is desirable to employ a barrel plating process whereby the apparatus is comprised of a mechanically rotated barrel which is perforated and contains a metallic plate bolted to the bottom of the barrel which in turn is connected to a commutator ring on the outside of the barrel. The barrels are made of inert material such as polypropylene. The cathode contact with the fasteners is usually made by metal discs on the bottom of the cylinder. The electrolyte permeates the barrel through the perforations and the anode is suspended just below the level of the solution.

SUMMARY OF THE DRAWINGS

FIG. 1 is a schematic illustration of a barrel plating apparatus and tank set-up used to carry out a process mode in conformity with this invention;

FIGS. 2 and 3 are enlarged schematic illustrations of a portion of a coating showing inorganic particles embedded in the coating, FIG. 2 employing conductive particles and FIG. 3 using nonconductive inorganic particles;

DETAILED DESCRIPTION

Figure 4:
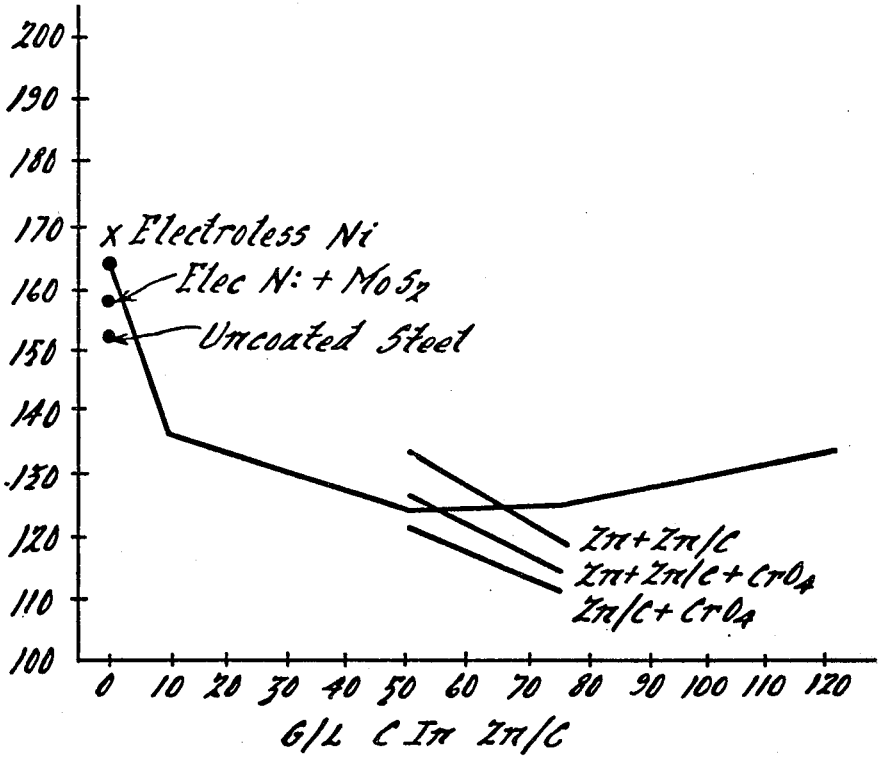
FIG. 4 is a graphical illustration showing the variation of coefficient of friction as a function of the type of material employed in the coating, particularly the concentration of graphite in a codeposit of zinc and graphite.

This invention has discovered that a codeposit of zinc and graphite with a critically high content of graphite will provide an unusually good combination of physical characteristics, including an ultralow coefficient of friction. The physical characteristics may comprise anticorrosion properties, good solderability, economy of processing and little or no stick slip problem. The prior art has never codeposited zinc/graphite and thus has failed to observe the most elementary threshold of improvement of this codeposited material. The codeposit of zinc and graphite has particular utility in the coating of fasteners, pins and gears.

A preferred method mode for obtaining the codeposit of this invention is as follows.

APPARATUS PREPARATION

Prior to performing the steps of the method, a processing and electrolytic plating system is prepared. As shown in FIG. 1, a barrel plating mode may be employed whereby rotatable cylinders 10, constructed of acid resistant, nonabsorbent material (such as polypropylene, resin bonded fiberglass, hard rubber, PVC, lucite, and phenolic laminates) are used to contain the parts to be plated while being tumbled. The cylinders are perforated and are mounted for rotation upon a horizontal axis, the trunions 11 for the axis being supported in a carriage 12 which is moved from tank to tank and is lowered into each tank for treatment therein. The series of tanks that may be employed with this method, and barrel plating apparatus, include a series of cleaning and rinsing tanks (not shown, which are interposed between process tanks). One or more of electrolytic plating tanks 13-14-15 are employed, followed by a suitable rinse tank 16. Only the electrolytic plating tanks are energized and contain an electrolyte. The parts, such as metal fasteners, are loaded in a bulk fashion into the cylinder through an access door thereof; the parts are connected as a cathode in the electrolytic plating cell by use of a metal plate bolted to the bottom of the barrel for contact with the batch of parts. The plate is connected by slip ring to an outside electrical supply. The anode can comprise a plurality of zinc elements extending into the bath containing the electrolyte solution and into which the barrels are lowered.

Proceeding now with the method steps of this invention:

1. Cleaning the Metal to be Plated

The substrate, or, in this case, a bulk quantity of metallic fasteners, is loaded into the barrel plating cylinder and carried through a series of cleaning tanks, which may preferably comprise a first bath having a highly alkaline solution effective to remove oil and gum deposits on the metallic substrate. The alkaline cleansed metal substrate is then rinsed by use of conventional tap water and then immersed in a pickling solution containing a concentration of about 30% hydrochloric acid, which is effective to remove oxides, followed by a conventional water rinse.

2. Immersing the Substrate in Suitable Plating Electrolyte

Prior to immersing the cleansed substrate into an acid zinc plating electrolyte for depositing a codeposit, the parts may preferably be preplated with 0.0002" zinc in a conventional acid zinc plating electrolyte.

The electrolyte for the codeposit contains 40 g/l zinc ions and 30–110 g/l insoluble bulk graphite. The zinc ions are obtained in the electrolyte by introducing a zinc anode into the bath solution; the bulk graphite is preferably introduced in a fine grade condition, optimally colloidal graphite, having a particle size in the range of 1–25 microns. Crude foundry grade graphite is operable within the scope of this invention, crude graphite having an average particle size of 25–100 microns. Utilizing the finer colloidal graphite will obtain a much smoother codeposit having typically an average particle size of 2 microns. If the graphite is added to the electrolyte in amounts less than 30 g/l, a noticeable increase in the coefficient of friction of the codeposit will result and make the coating less effective in performing as a low friction composite. If the graphite is added to the solution and maintained in a suspension quantity of greater than 110 g/l, the graphite will plate out in an amount which will be greater than 50% of the codeposit and thus substantially reduce the ability of the codeposit to have anticorrosion characteristics attributable to the presence of zinc.

Preferably the acid zinc electrolyte is prepared by adding to an aqueous solution 45–110 g/l zinc chloride and 100–200 g/l sodium chloride. The pH of such acid bath should be maintained in the range of 5–5.7 and optimally about 5.3. This bath has the advantage of plating on difficult metals and will have an almost 100% cathode efficiency. Alternatively, the acid chloride bath may be prepared by using 70–85 g/l zinc chloride and 100–150 g/l of potassium chloride. Boric acid in the range of 26–40 g/l may be added as a buffering agent.

To improve the grain refinement of the resulting codeposit, 0.4–0.1 g/l of unflavored gelatin may be added to the electrolyte. Additionally, 0.1–4.0 g/l cocamine acetate (having the molecular formula of $C_{12}H_{25}NH_3$) is added, which serves to facilitate the deposition of nonconductive particles.

The pH range should be regulated as given. If higher than such range, zinc hydroxide will form which is undesirably insoluble. If lower than 5, the acidity of the electrolyte will affect cohesion. The electrolyte should be maintained in a temperature range of 75°–90° F.

It is essential to employ an acid zinc plating electrolyte so as to enable the cohesion of the inert graphite particles to facilitate forming the codeposit.

3. Energizing the Electrolytic Cell

The electrolytic cell is energized at a sufficient current density to plate the zinc onto the substrate without burning while continuously agitating the graphite into suspension throughout said electrolyte. The agitation is periodically interrupted to allow the graphite to settle and comingle with the zinc as the plating takes place on the cathode. Preferably the agitation is carried out by the use of air pulsing and is interrupted for periods of 15–60 seconds at intervals of 15–180 seconds. During all other times the air pulsing is on. The current density is preferably employed in the low range of 1–20 amps per square foot (0.1–2.0 amps/dm$^2$). If the current density is lower than this value, insufficient plating zinc will take place. If the amperage is much higher, there is a tendency for the zinc to be burned during its electroplating process. The generally inert graphite particles will accept an electrostatic charge that is promoted by the electrolytic cell. The charge is very light and therefore migration of the particles to the cathode is extremely sensitive. It is important that agitation be employed so that there is, in suspension, the critical range of 30–110 g/l of graphite. The amount of agitation to maintain such suspension is determined by the specific gravity of the electrolyte.

As shown by the comparison of FIGS. 2 and 3, the surface profile of a codeposited material will have a surface roughness which will vary depending upon whether highly conductive particles are entrapped by the metal or whether the particles are substantially nonconductive. In FIG. 2, cobalt particles are enveloped by the primary plating metal causing a relatively rough surface to be formed. Graphite particles, which carry a low level of electrostatic charge, are embedded within the plating metal primarily by a settling action and are not enveloped by the plating metal resulting in a much smoother finish (see FIG. 3).

Figure 5:
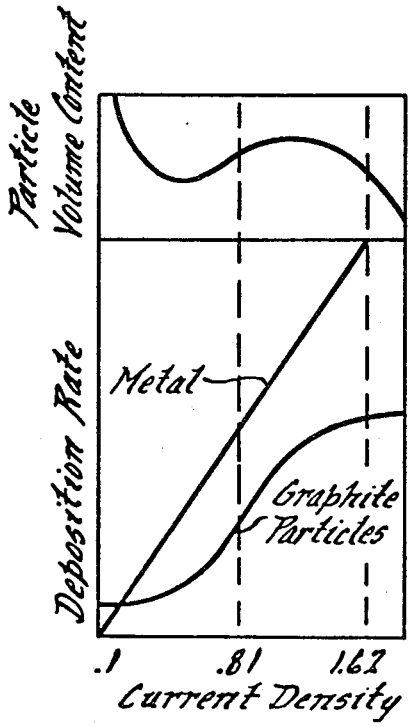
FIG. 5 is a graphical illustration of the deposition rate or volume of the codeposited materials of this invention as a function of the current density.

The rate of zinc metal deposition affects the entrapment rate of the graphite particles during the coating of the cathode. There is a relatively low level of electrostatic attraction between the graphite particles and the cathode, and this electrostatic force can be easily interrupted or overcome by a mechanical agitation force. It has been found that by controlling the current density (which controls the deposition rate of the metal indirectly), and controlling the force of agitation which disrupts such deposition, the graphite deposition rate and graphite particle volume can be optimized (see FIG. 5). If a current density of between 0.8–1.6 amps/dm$^2$ is employed, the best graphite rate as well as graphite volume deposition is obtained. This is conditioned upon the interruption of the agitation force for 15–60 second periods at intervals of 15–180 seconds to allow for such deposition rate to take place.

4. Chromate Outer Coating

It is desirable to dip the electroplated codeposit in a solution containing an acid chromate for a period of 10–45 seconds to form a very thin chromate outer coating on the metal substrate. The chromate should typically have a thickness of $2^{-5}$ inches thick. The zinc/-graphite plated part is dipped in a chromating solution consisting of 30 g/l chromic acid, 10 cc/l phosphoric acid, 5 cc/l hydrochloric acid, 5 cc/l nitric acid, and 5 cc/l sulfuric acid for a period of about 30 seconds, followed by a warm rinse of about 30 seconds. When the solution has a pH range of 1.0–2.0, an olive drab chromate coating will be obtained which has the characteristic of good corrosion protection. The color of such chromate conversion coating is dependent upon the thickness of the coating and also the trivalent chromium content of the bath (0.1–4 g/l). The color is relatively clear and bright for the thinnest coating, proceeding to a blue-bright, then yellow iridescent in progressively thicker coatings, to the heaviest coating of brown or olive drab colors. A more complete disclosure of the application of chromate coatings is set forth in "Conversion Coartings-Chromate Films", by L. F. Spencer, *Metal Finishing*, pp. 58–65, January 1960 (which disclosure is incorporated herein by reference).

The chromate conversion coating on the codeposit of this invention renders exceptionally good corrosion resistance because of (a) the corrosion inhibiting effect of hexavalent chromium contained in the chromate film, and (b) to the physical barrier presented by the chromate film itself. The film is formed by the chemical reaction of the hexavalent chromium with the zinc metal surface in the presence of activators in the acid solution. The hexavalent chromium is partially reduced to trivalent chromium during the reaction with a concurrent rise in pH, forming a complex mixture consisting largely of hydrated basic chromium chromate and hydrus oxides of both chromium and the zinc metal. It is important that the pH of the treatment solution be maintained in the critical range of 1.0–2.0 to obtain an appropriate chromate conversion coating. The activators useful in forming the conversion coating include acetate formate, sulphate, chloride, fluoride, nitrate phosphate, and sulphamate ions. For purposes of this invention, the immersion time for a conversion coating herein is relatively short, a period of 20–30 seconds.

Test Samples

A series of samples were prepared in conformity with the preferred mode. Each of the samples were iron based nuts; some preplated with 5 microns zinc, and all plated with 8 microns of zinc/graphite. The zinc/-graphite plating solution contained 75 g/l of graphite. The zinc/graphite codeposit in some samples was passivated with a chromate film of a thickness of 0.00002". The samples were subjected to a chemical content analysis to determine the content of graphite and the corresponding coefficient of friction at a torque load of 40 ft/lbs. The solution was varied with a variety of graphite contents; the results of such analysis are shown in the following Table 1.

TABLE 1

| Coating System | Content of Graphite in Bath Solution | Coefficient of Friction |
|---|---|---|
| Zinc/Graphite | 120 g/l | .134 |
| " | 75 g/l | .125 |
| " | 50 g/l | .124 |
| " | 10 g/l | .137 |
| Zinc + Zinc/Graphite | 75 g/l | .120 |
| Zinc + Zinc/Graphite + $CrO_4$ | 75 g/l | .115 |
| Zinc/Graphite + $CrO_4$ | 75 g/l | .112 |

From such Table it is quite evident that the coefficient of friction of the codeposit of zinc and graphite provides an unusually low coefficient of friction. However, when the graphite content in solution is less than 30 g/l, insufficient graphite is deposited to reduce the coefficient of friction (acceptable is 0.130). When the graphite in solution is in excess of 110 g/l, the coefficient of friction again rises inordinately. From this it has been determined that the effective operable range for the graphite in the electrolyte should be 30–110 g/l and preferably 50–75 g/l (see FIG. 4). It is significant that the coefficient of friction utilizing this preferred process results in a codeposit that has a coefficient of friction substantially less than alternative coating systems used by the prior art (see the following Table 2).

TABLE 2

| Coating System | Coefficient of Friction |
|---|---|
| Teflon | 0.225 |
| Phosphate/Oil | 0.197 |
| Electroless Nickel | 0.168 |
| Zinc Electroplate | 0.163 |
| Electroless Nickel/$MoS_2$ | 0.158 |
| Uncoated Steel | 0.153 |
| Zinc/$MoS_2$ | 0.138 |
| Zinc/Graphite | 0.125 |
| Cadmium Electroplate | 0.123 |
| Cadmium/Chromate | 0.118 |
| Zinc + Zinc/Graphite + $CrO_4$ | 0.112 |

Some of these samples were also analyzed as to the graphite content in the resulting coated system as a function of the graphite concentration in the bath solution. The results are shown in Table 3 below.

TABLE 3

| Graphite Content in Bath (g/l) | Graphite Content in Deposit (% wt.) |
|---|---|
| 20 | 4 |
| 30 | 30 |
| 50 | 40 |
| 110 | 48 |
| 120 | 50 |

Figure 6:
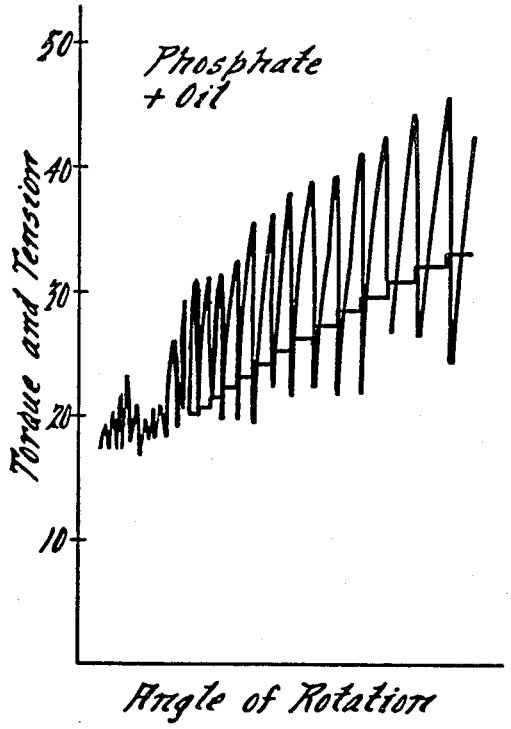
FIGS. 6–8 each respectively illustrate a graphical illustration of torque and tension as a function of the angle of rotation of a fastener coated respectively with phosphate and oil (FIG. 6), zinc and graphite codeposit with a chromate outer coating (FIG. 7), and a cadmium plate with a chromate outer coating (FIG. 8)
Figure 8:
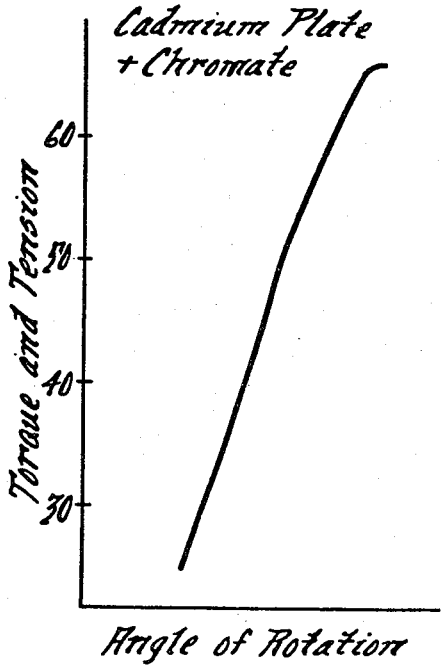
Figure 7:
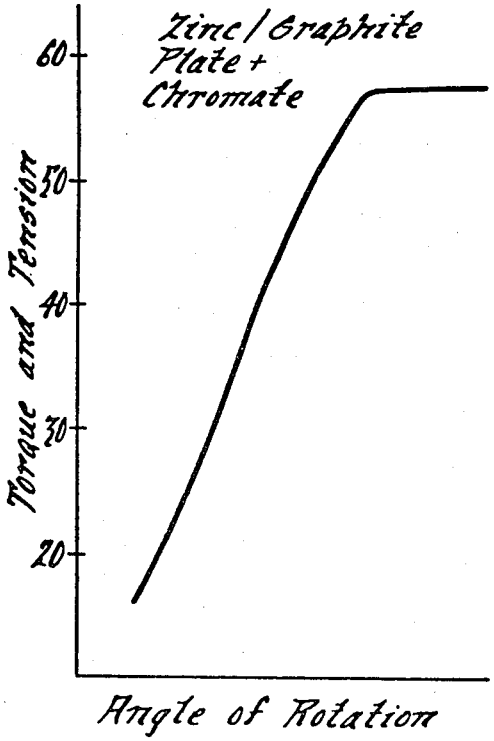
Figure 9:
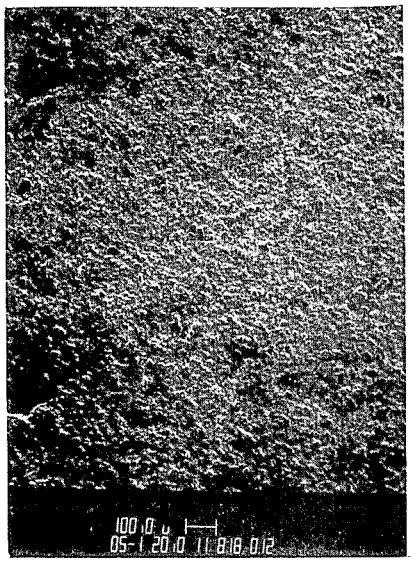
FIGS. 9–11 each respectively illustrate a scanning electron microscope photograph (at 100X) of coatings prepared in accordance with the process teaching of this invention, FIG. 9 illustrating a coating prepared with a concentration of 120 g/l of graphite in the electrolyte, FIG. 10 illustrating a coating prepared from a 75 g/l concentration of graphite in the electrolyte, and FIG. 11 illustrating a concentration of 50 g/l graphite in the electrolyte.
Figure 10:
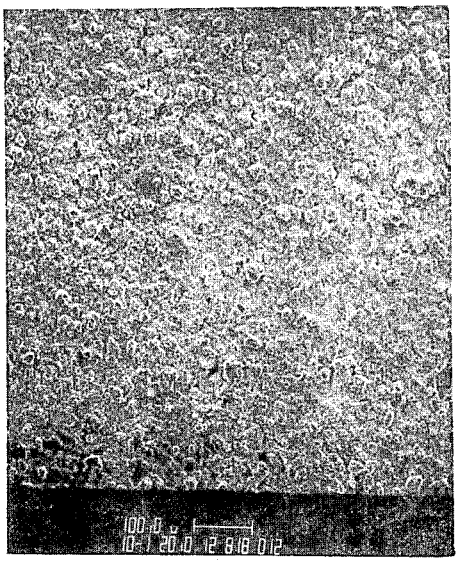
Figure 11:
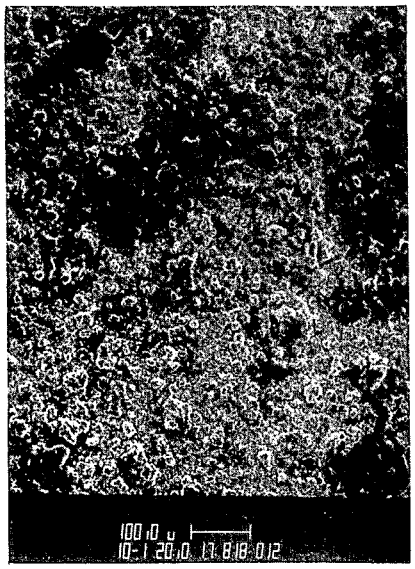
Figure 12:
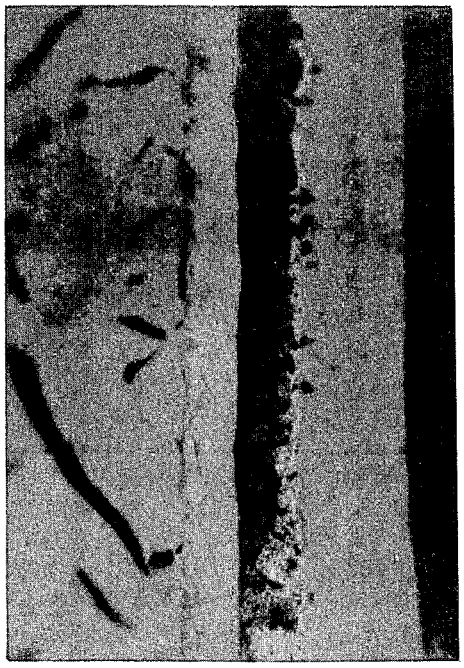
FIG. 12 is an electron scanning microscope photograph of a section of a coating prepared in accordance with this invention showing the various layers of the coating as labeled.

Each of the samples were analyzed for their ability to resist the stick-slipping problem. Each of the fasteners was subjected to a torqueing test whereby a torque measured in foot/pounds is applied to the fastener and the resulting tension of the fastener is plotted against the degree of angle rotation. As the coated nut is fastened to a connecting rod, loading requirements can vary with severe, jerky vacillations. For a prior art coating system, of phosphate and oil, FIG. 6 shows the severe vacillations that are encountered as a result of the stick-slip problem. When the nut is coated with a cadmium deposit the aberrations are removed and there is a smooth torqueing curve without the erratic behavior, as shown in FIG. 8. This same type of smooth torqueing behavior has been experienced with the zinc/graphite codeposit containing a chromate outer coating; this is shown in FIG. 7.

To determine the corrosion resistance of the codeposit of this invention, the samples were subjected to a salt spray test according to the ASTM B117 test procedure in a 5% salt spray test. Nuts plated with 13 microns of zinc/graphite from either 50, 75 or 120 g/l graphite bath solution and passivated with a chromate film, passed 120 hours of the salt spray test (see the following Tableh 4). Another corrosion test includes the exposure of fasteners mounted on vehicles traveling in the Detroit, Michigan and Buffalo, New York areas of the United States. After one winter of exposure (four months) there was no corrosion on samples plated with zinc/graphite in thicknesses of 0.2–0.7 mil or fasteners plated with 0.5 mil cadmium. These results were obtained on passivated and unpassivated zinc/graphite composites.

TABLE 4

| Sample | Grams/Liter of Graphite | Presence of Chromate Conversion Coating | Hours of Satisfactory Salt Spray Resistance for Thickness of .5 mils (72 is acceptable) |
|---|---|---|---|
| Zinc + Zinc/Graphite | 20 | No | 72 |
| " | 20 | Yes | 120 |
| " | 50 | No | 72 |
| " | 50 | Yes | 120 |
| " | 120 | No | 48 |
| " | 120 | Yes | 120 |
| Zinc/Graphite | 20 | No | 72 |
| " | 20 | Yes | 120 |
| " | 50 | No | 72 |
| " | 50 | Yes | 120 |
| " | 75 | No | 48 |
| " | 75 | Yes | 120 |
| Phosphate in Oil | — | — | 48 |
| Cadmium | — | Yes | greater than 288 |

These same samples were then subjected to a solderability test. The nuts with various coating systems were tested to investigate their suitability for soldering. As a qualitative evaluation, all of the nuts or screws coated with a zinc+zinc/graphite or zinc/graphite and chromate conversion coating, whether they be with a 20 g/l graphite solution or made with a 120 g/l bath solution, the solderability was excellent in all cases. However, coating systems of phosphate and oil did not provide good solderability with a resin solder cord nor with a zinc chloride containing flux. Plain steel demonstrated poor solderability with resin solder cord. Thus it has been demonstrated that the codeposit of this invention provides excellent solderability characteristics if that is necessary in the application.

In addition, the codeposit of this invention is dry to the touch, which is often commercially difficult to consistently achieve with fasteners coated with phosphate and oil. The shelf life of the codeposit is excellent, having a life of well over one year, and is economical to finish while presenting no hazards with respect to toxic processing considerations. The raw materials for the system are relatively plentiful.

We claim:

1. An electrolytic codeposit of zinc and graphite useful as a composite coating on parts subject to sliding friction, said codeposit containing uniformly distributed graphite in an amount of 30–48% by weight of the codeposit, a coefficient of friction equal to or less than 0.130, at a plated thickness of about 0.0005", showing (a) no red rust in a salt spray environment for at least 72 hours, and (b) no destruction due to corrosion in an industrial environment containing sulphur dioxide after four months.

2. The codeposit of claim 1, wherein the codeposit is effectively solderable using either a resin solder cord or zinc chloride containing flux.

3. The codeposit of claim 1, electrodeposited on a threaded fastener and subsequently coated with zinc chromate in a thickness of about 0.00002", said coated fastener exhibiting consistent torque performance at a torque load of 40 pounds, a coefficient of friction of about 0.112 or less, and no red rust in a salt spray environment for at least 120 hours.

4. A method of electrodepositing zinc and graphite onto at least a vertical conductive metal substrate by the use of an electrolytic cell having a zinc anode and the metal substrate connected as a cathode, comprising the steps:

(a) immersing said substrate in a cleansed condition into an acid/zinc plating electrolyte containing at least 40 g/l zinc ions and 30–110 g/l insoluble bulk graphite, said electrolyte having a pH of 5–5.7; and (b) energizing said electrolytic cell at a sufficient current density to plate out zinc onto said surface without burning while continuously agitating said graphite into uniform suspension throughout said electrolyte, said agitation being periodically interrupted to allow said graphite to settle and comingle with said zinc as it is plating out on said cathode.

5. The method as in claim 4, in which said agitation is periodically interrupted for 15 to 60 second periods at intervals of 15 to 180 seconds.

6. The method as in claim 4, in which said bulk graphite has an average particle size of 1–25 microns and is colloidal.

7. The method as in claim 4, in which said electrolyte is of the acid chloride type constituted by either adding 70–85 g/l zinc chloride with 100–150 g/l potassium chloride, or 45–110 g/l zinc chloride with 100–200 g/l sodium chloride, said electrolyte also containing 26–40 g/l boric acid.

8. The method as in claim 6, in which said electrolyte additionally contains 0.4–0.1 g/l gelatin.

9. The method as in claim 6, in which said electrolyte additionally contains 0.1–4.0 g/l cocamine acetate having the formula $C_{12}H_{25}NH_3$.

10. The method as in claim 4, in which said electrolytic cell is energized by a current density of 1–20 amps per square foot (0.1–2.0 amps/dm$^2$).

11. The method as in claim 4, in which said agitation is carried out by the use of air pulses into said electrolyte.

12. The method as in claim 4, in which said electrolyte is maintained at a temperature of 75°–90° F.

13. The method as in claim 4, in which said metal substrate is selected from the group consisting of steel, copper, nickel, brass, bronze, zinc, and aluminum, as well as conductive plastics.

14. The method as in claim 4, in which said process additionally comprises the step of dipping said codeposited material into a chromate solution for a period of 10–30 seconds to form a conversion coating on said codeposit consisting of zinc chromate.

15. A method of electroplating a batch of threaded metal fasteners by the use of a barrel plating apparatus having a perforated barrel within which is introduced the electroplating electrolyte solution with the fasteners contacted to constitute a cathode and a suspended zinc anode, the method comprising:

(a) dipping said barrel contained fasteners sequentially through a series of tanks, the tanks including a caustic cleaning solution, water rinse, a pickling solution for removing oxides, a water rinse, a zinc/graphite plating solution, and a water rinse;

(b) energizing said zinc/graphite plating electrolyte when said barrel contained fasteners are immersed in said solution, said energization being carried out at a level to plate out zinc on said fasteners without burning, said plating being carried out the injection of jet streams of compressed air to maintain the graphite continuously in suspension within said solution;

(c) interrupting said barrel rotation and air agitation periodically to allow said graphite to migrate and plate out with said zinc on the cathode.

16. The method as in claim 15, in which said barrel rotation and air agitation is interrupted for periods of 15/60 seconds at intervals of 15/180 seconds.

17. A high lubricity coating material consisting of electrocodeposited zinc and graphite uniformly distributed, said graphite being present in an amount of at least 30% by weight of the coating, said coating having a coefficient of friction equal to or less than 0.113 at 40 ft/lb torque loading.

18. The coating material as in claim 15, in which said electrodeposited coating has a chemically applied outer layer of zinc chromate in a thickness of 0.00002", said codeposited coating having a high degree of resistance to salt spray corrosion.

19. An electroplated threaded fastener comprising:

(a) a substrate of a metal selected from the group consisting of steel, copper, nickel, bronze, brass, zinc, and aluminum;

(b) a tightly adherent electrodeposited composite material consisting of zinc and graphite, the graphite being present in an amount of at least 30% by weight of the material; and (c) a conversion zinc chromate outer layer.

20. The electroplated threaded fastener of claim 19, in which said coefficient of friction is equal to or less than 0.113, and has a corrosion resistance performance which will provide at least 120 hours of exposure to salt spray environment with no visible red or white corrosion products and exhibit a consistent torque tension relationship.

* * * * *